US005422316A

United States Patent [19]

Desai et al.

[11] Patent Number: 5,422,316

[45] Date of Patent: Jun. 6, 1995

[54] SEMICONDUCTOR WAFER POLISHER AND METHOD

[75] Inventors: Ankur H. Desai, St. Peters; Michael S. Wisnieski, O'Fallon; David I. Golland, Chesterfield, all of Mo.

[73] Assignee: MEMC Electronic Materials, Inc., St. Peters, Mo.

[21] Appl. No.: 214,969

[22] Filed: Mar. 18, 1994

[51] Int. Cl.[6] ..... H01L 21/465

[52] U.S. Cl. ..... 437/228; 437/974

[58] Field of Search ..... 437/228, 231, 8, 233, 437/249, 966, 946, 974; 156/645, 636, 662

[56] References Cited

U.S. PATENT DOCUMENTS

| | | | |
|---|---|---|---|
| 2,979,868 | 4/1961 | Emeis | 51/131 |
| 3,559,346 | 2/1971 | Paola | 51/57 |
| 4,104,099 | 8/1978 | Scherrer | 156/155 |
| 4,165,584 | 8/1979 | Scherrer | 51/131.1 |
| 4,256,535 | 3/1981 | Banks | 156/645 |
| 4,735,679 | 4/1988 | Lasky | 156/636 |
| 4,910,155 | 3/1990 | Cote et al. | 437/8 |
| 5,032,544 | 7/1991 | Ito et al. | 437/228 |
| 5,110,428 | 5/1992 | Prigge et al. | 204/129.3 |
| 5,191,738 | 3/1993 | Nakazato et al. | 51/283 R |
| 5,274,960 | 1/1994 | Karlsrud | 51/109 R |

FOREIGN PATENT DOCUMENTS

| | | |
|---|---|---|
| 2521895 | 8/1983 | France . |
| 55-157472A | 12/1980 | Japan . |
| 64-51268A | 2/1989 | Japan . |
| 64-71663A | 3/1989 | Japan . |
| 1-246070A | 10/1989 | Japan . |
| 1151436A | 4/1985 | U.S.S.R. . |

OTHER PUBLICATIONS

E. Mendel and J. S. Basi, IBM Data Systems Division, Multiple Wafer Free Polishing–Part 2, Process, Apr. 10, 1980.

*Primary Examiner*—R. Bruce Breneman
*Assistant Examiner*—Joni Y. Chang
*Attorney, Agent, or Firm*—Senniger, Powers, Leavitt & Roedel

[57] ABSTRACT

A semiconductor wafer polisher of the present invention for polishing at least one semiconductor wafer to flatten a first face of the wafer and reduce the thickness of the wafer from an initial thickness $t_1$ to a predetermined final thickness $t_2$. The polisher comprises a first surface including a polishing surface portion, a second surface including a second surface portion, and a wafer carrier for holding the semiconductor wafer between the polishing surface portion and the second surface portion. At least one polishing limiter is between the first and second surfaces for limiting the reduction in thickness of the wafer. The wafer carrier and polishing limiter are integrally formed such that the polishing limiter and wafer carrier constitute a single unitary piece. The polishing limiter has at least one rubbing surface adapted for rubbing against one of the first and second surfaces and is sized and configured such that the rubbing surface is spaced axially from the one of the first and second surfaces when the semiconductor wafer has the thickness $t_1$ and such that the rubbing surface rubs against the one of the first and second surfaces and the polishing limiter extends from the second surface to the first surface when the semiconductor wafer has the thickness $t_2$. The polishing limiter has a greater resistance to polishing than that of the semiconductor wafer such that the polishing limiter prevents the polishing surface and the second surface portion from further moving axially toward each other when the polishing limiter extends from the second surface to the first surface to prevent the wafer from being reduced in thickness beyond the thickness $t_2$.

22 Claims, 3 Drawing Sheets

SEMICONDUCTOR WAFER POLISHER AND METHOD

BACKGROUND OF THE INVENTION

This invention relates generally to semiconductor wafer shaping, and more particularly to semiconductor wafer polishers for polishing the faces of semiconductor wafers.

The final step in a conventional semiconductor wafer shaping process is a polishing step to produce a highly reflective and damage-free surface on one face, and sometimes both faces, of the semiconductor wafer. Polishing of the wafer is accomplished by a mechanochemical process in which a rotating polishing pad rubs a polishing slurry against the wafer. The slurry includes fine silica particles (mechanical action) suspended in an alkali solution (chemical action).

Semiconductor electronic devices are fabricated from polished semiconductor wafers. The requirement for geometrical tolerance of the polished wafer has become more stringent as the complexity of device design has increased. Microscopic device geometries require each wafer to have a predetermined uniform thickness and to have at least one face which deviates less than one micrometer from the highest point to the lowest point when the wafer is held on a flat vacuum chuck.

SUMMARY OF THE INVENTION

Among the several objects of this invention may be noted the provision of improved semiconductor wafer polisher and method for polishing wafers to a predetermined thickness; the provision of such a polisher and method utilizing a polishing limiter for preventing wafers from being reduced beyond the predetermined thickness.

In general, a semiconductor wafer polisher of the present invention is adapted for polishing at least one semiconductor wafer having first and second opposite faces. The polisher is adapted to polish the first face of the semiconductor wafer to flatten the first face and reduce the thickness of the wafer from an initial thickness $t_1$ to a predetermined final thickness $t_2$. The final thickness $t_2$ is thinner than the initial thickness $t_1$. The polisher comprises a first table having a first plate and a first surface on the first plate. The first surface includes a planar first surface portion adapted to abut the first face of the semiconductor wafer. The polisher also has a second surface including a planar second surface portion adapted to abut the second face of the semiconductor wafer. At least one of the first and second surfaces is rotatable about an axis to effectuate relative rotation between the planar first and second surface portions. The first and second surface portions lie in respective parallel planes. The first surface portion comprises a planar polishing surface. The relative rotation between the first and second surfaces effectuates relative rotation between the polishing surface and the first face of the semiconductor wafer for polishing the first face. The planar polishing surface and the second surface portion are urged toward each other to press the first face of the semiconductor wafer and the polishing surface against each other such that the planar polishing surface rubs against the first face of the semiconductor wafer upon rotation of the polishing surface relative to the semiconductor wafer to wear against the first face of the semiconductor wafer. The polishing surface and the second surface portion move axially toward each other as the semiconductor wafer is reduced in thickness. The polisher further includes a wafer carrier for holding the semiconductor wafer between the polishing surface and the second surface portion. A polishing limiter is between the first and second surfaces for limiting the reduction in thickness of the wafer and is integrally formed with the wafer carrier such that the polishing limiter and wafer carrier constitute a single unitary piece. The polishing limiter has at least one rubbing surface adapted for rubbing against one of the first and second surfaces. The polishing limiter is sized and configured such that the rubbing surface is spaced axially from the one of the first and second surfaces when the semiconductor wafer has the thickness $t_1$ and such that the rubbing surface rubs against the one of the first and second surfaces and the polishing limiter extends from the second surface to the first surface when the semiconductor wafer has the thickness $t_2$. The polishing limiter has a greater resistance to polishing than that of the semiconductor wafer such that the polishing limiter prevents the polishing surface and the second surface portion from further moving axially toward each other when the polishing limiter extends from the second surface to the first surface to prevent the wafer from being reduced in thickness beyond the thickness $t_2$.

In another aspect of the present invention, a method of polishing a semiconductor wafer comprises supporting the semiconductor wafer with a wafer carrier having a support plate and a generally planar wafer holding surface on the support plate. The second face of the wafer is held against the holding surface. A polishing table is positioned against the first face of the semiconductor wafer. The polishing table has a polishing plate and a planar polishing surface on the polishing plate lying in a plane parallel to the planar wafer holding surface. The planar polishing surface abuts the first face of the semiconductor wafer. At least one of the wafer carrier and polishing table is rotatable about an axis to effectuate relative rotation between the wafer carrier and polishing table. Reduction in thickness of the semiconductor wafer is limited with a polishing limiter. The polishing limiter is integrally formed with one of the support plate and polishing plate such that the polishing limiter and the one of the support plate and polishing plate constitute a single unitary piece. The polishing limiter extends axially from the one of the support plate and polishing plate toward the other of the support plate and polishing plate and has a plate rubbing surface adapted for rubbing against the other of the support plate and polishing plate. The polishing limiter is sized and configured such that the plate rubbing surface is axially spaced from the other of the support plate and polishing plate when the semiconductor wafer has the thickness $t_1$ and such that the plate rubbing surface rubs against the other of the support plate and polishing plate when the semiconductor wafer has been reduced to the thickness $t_2$. The plate rubbing surface has a greater resistance to polishing than that of the semiconductor wafer such that the polishing limiter prevents the wafer holding surface and the polishing surface from moving axially toward each other when the plate rubbing surface rubs against the other of the support plate and polishing plate to prevent the wafer from being reduced in thickness beyond the thickness $t_2$. At least one of the wafer carrier and the polishing table are rotated about the axis to effectuate relative rotation between the polishing surface and the first face of the semiconductor wafer. The planar wafer holding surface and the planar polishing surface are urged toward each other during relative rotation between the polishing surface and the first face of the semiconductor wafer to press the first face of the semiconductor wafer and the polishing surface against each other such that the planar polishing surface rubs against the first face of the semiconductor wafer to wear against the first face of the semiconductor wafer. The wafer holding surface and the polishing surface move axially toward each other as the semiconductor wafer is reduced in thickness and until the semiconductor wafer has been reduced to the thickness $t_2$. The plate rubbing surface rubs against the other of the support plate and polishing plate when the semiconductor wafer has been reduced to the thickness $t_2$ to prevent the wafer holding surface and the polishing surface from further moving axially toward each other thereby to prevent the wafer from being reduced in thickness beyond the thickness $t_2$.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
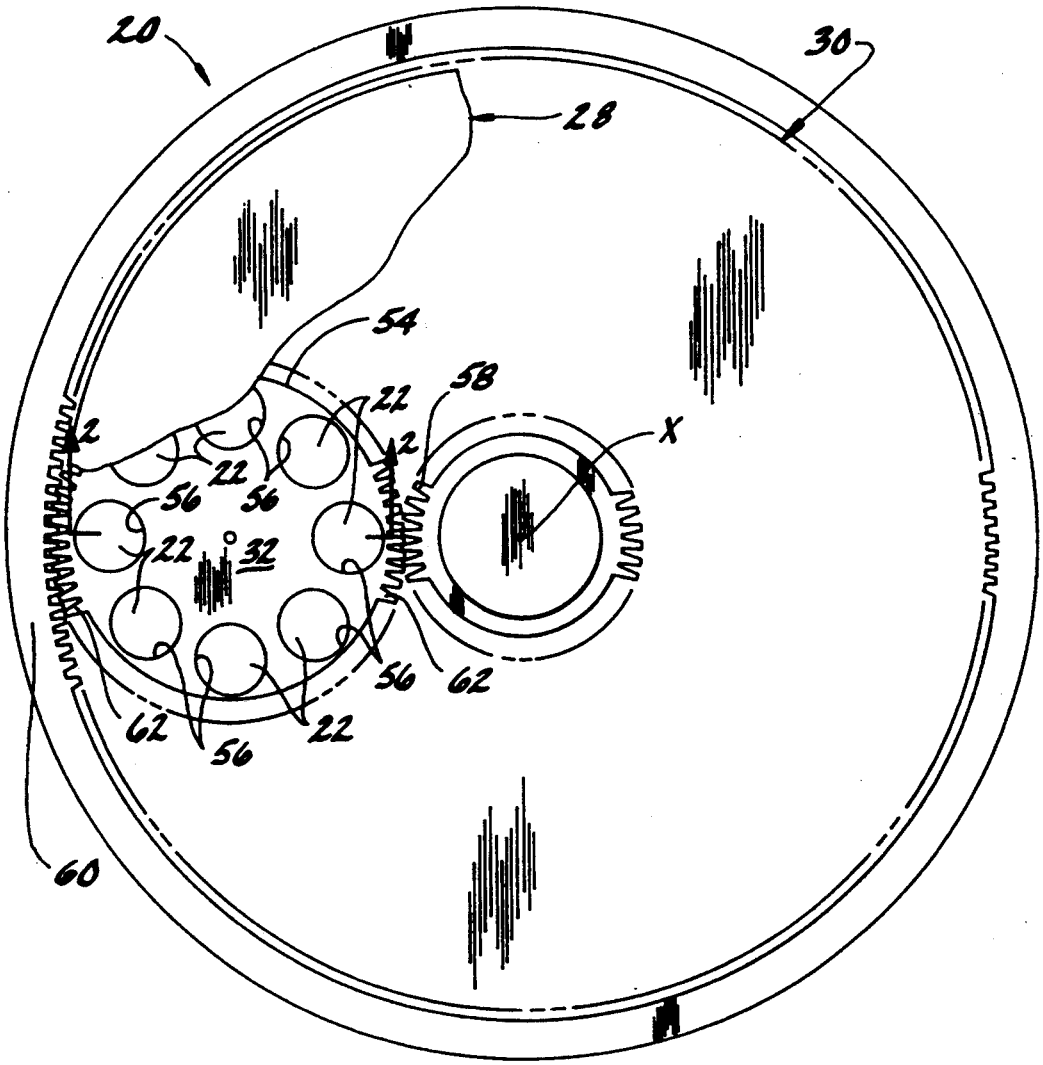
FIG. 1 is a top plan view of a semiconductor polisher of the present invention with portions broken away to show detail.
Figure 2:
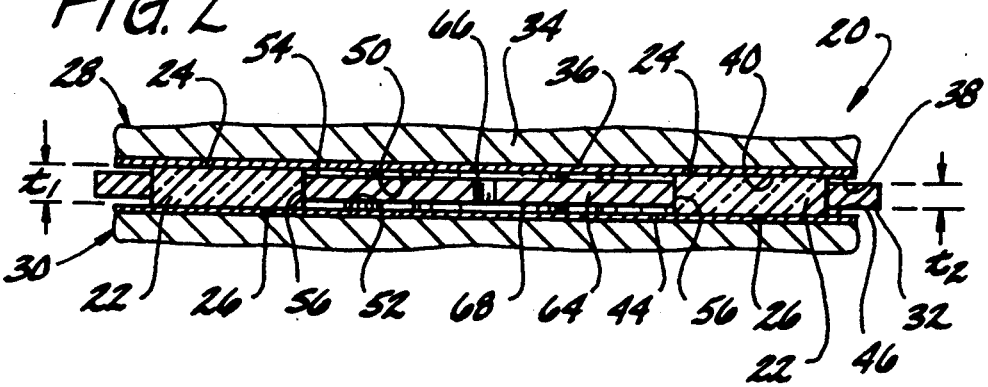
FIG. 2 is a section view taken along the plane of line 2—2 of FIG. 1 showing semiconductor wafers held by a wafer carrier.
Figure 3:
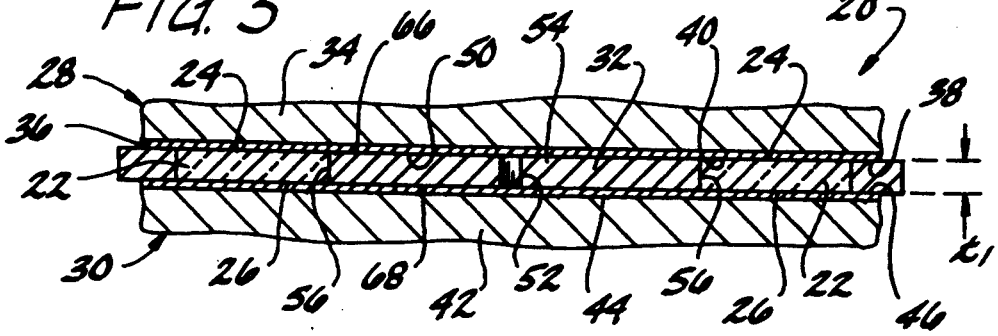
FIG. 3 is a vertical section view similar to FIG. 2 but with the semiconductor wafers having been reduced in thickness equal to the thickness of the wafer carrier.

Referring now to the drawings, and first more particularly to FIGS. 1–3, a semiconductor wafer polisher of the present invention, indicated in its entirety by the reference numeral 20, is adapted for polishing a plurality of semiconductor wafers 22. Each semiconductor wafer 22 has an upper face 24 and a lower face 26. The polisher 20 is a double sided polisher adapted to polish both faces of each semiconductor wafer 22 to flatten each face and reduce the thickness of the wafer from an initial thickness $t_1$ (FIG. 2) to a predetermined final thickness $t_2$. Although the initial thickness of each semiconductor wafer shown in FIG. 2 is the same, it is to be understood that the initial thickness may vary from wafer to wafer. However, the final thickness $t_2$ is thinner than the initial thickness $t_1$ of any semiconductor wafer to be polished.

The polisher 20 comprises upper (or first) and lower (or second) polishing tables 28, 30, respectively, and a wafer carrier 32. The upper polishing table 28 has an upper (or first) plate 34 and an upper polishing pad 36 on the upper plate. The upper polishing pad 36 includes a downwardly facing surface 38 having a planar first surface portion 40 adapted to abut and rub against the upper face 24 of each semiconductor wafer 22. The lower polishing table 30 has a lower (or second) plate 42 and a lower polishing pad 44 on the lower plate. The lower polishing pad 44 includes an upwardly facing surface 46 having a planar second surface portion 48 adapted to abut and rub against the lower face 26 of each semiconductor wafer 22. Preferably, the upper and lower polishing pads 36, 44 are of a polyurethane impregnated polyester felt or other suitable material. The first and second surface portions 40, 48 of the upper and lower polishing pads 36, 44 comprise upper and lower planar polishing surfaces 50, 52, respectively. The upper and lower polishing surfaces lie in respective parallel planes so that the upper and lower faces 24, 26 of the semiconductor wafers 22 (when polished) will lie in parallel planes and the thickness of the wafers 22 will be uniform. The upper and lower tables 28, 30 are both rotatable about an axis X (FIG. 1) which is perpendicular to the planes of the first and second surface portions 40, 48. The tables 28, 30 are adapted to counter-rotate during polishing of the semiconductor wafers 22 with the upper table 28 rotating counterclockwise as viewed in FIG. 1 and the lower table 30 rotating clockwise.

The wafer carrier 32 holds the semiconductor wafers 22 between the upper and lower polishing surfaces 50, 52 during polishing and comprises a generally circular plate 54 with a plurality of openings 56 for receiving the semiconductor wafers 22. Preferably, the openings 56 are sized and shaped for limiting lateral movement of the wafers 22 relative to the carrier 32 while allowing free rotation of the wafers within the openings. The wafer carrier is positioned axially between the upper and lower polishing surfaces 50, 52 and laterally between a sun gear 58 and a ring gear 60 (FIG. 1). A plurality of gear teeth 62 extend radially outwardly at the periphery of the circular plate 54 and intermesh with gear teeth of the sun and ring gears. The sun and ring gears rotate about the axis X and turn the carrier 32. Preferably, the sun and ring gears 58 and 60 rotate in the same direction (e.g., clockwise as viewed in FIG. 1) but at different rotational speeds (i.e., different rpms) to cause the carrier 32 to rotate about its center point and also revolve around the axis X.

Rotation of the upper table 28, lower table 30, sun gear 58 and ring gear 60 causes relative rotation between the upper polishing surface 50 and the upper faces 24 of the wafers 22 and relative rotation between the lower polishing surface 52 and the lower faces 26 of the wafers. The upper and lower tables 28, 30 are urged toward each other by the weight of the upper table and/or by other conventional means to press the upper polishing surface 50 against the upper faces 24 and press the lower polishing surface 52 against the lower faces 26 so that the upper polishing surface rubs against the upper faces and the lower polishing surface rubs against the lower faces upon rotation of the polishing surfaces to wear against the faces of the wafers. As the upper and lower faces 24, 26 of the semiconductor wafers are polished, the thickness of the wafers decreases and the polishing surfaces move axially toward each other. Preferably, the respective speeds of the upper table 28, lower table 30, sun gear 58 and ring gear 60 are selected to provide substantially uniform polishing rates of the upper face 24 and lower face 26 of each wafer 22.

The circular plate 54 of the wafer carrier 32 constitutes a polishing limiter 64 for limiting the reduction in thickness of the wafers 22. The polishing limiter 64 has planar upper and lower rubbing surfaces 66, 68. The upper rubbing surface 66 is adapted for being rubbed by the upper polishing surface 50, and the lower rubbing surface 68 is adapted for being rubbed by the lower polishing surface 52. Preferably, the thickness of the polishing limiter 64 (i.e., the axial distance between the upper and lower rubbing surfaces) is equal to the predetermined final thickness $t_2$. Since the thickness of the polishing limiter 64 is less than the initial thickness $t_1$ of the wafers 22, not more than one of the upper and lower rubbing surfaces of the polishing limiter is rubbed by one of the polishing surfaces when the wafers are at their initial thickness. In other words, before the wafers have been polished to their predetermined final thickness, the upper rubbing surface 66 is axially spaced from the upper polishing surface 50 and/or the lower rubbing surface 68 is axially spaced from the lower polishing surface 52. The polishing limiter has a greater resistance to polishing than that of the semiconductor wafers 22 so that the polishing limiter prevents the polishing surfaces from further moving axially toward each other when the rubbing surfaces 66, 68 of the polishing limiter are simultaneously rubbed by the polishing surfaces. Thus, the polishing limiter 64 prevents the semiconductor wafers 22 from being reduced beyond the thickness $t_2$. The polishing limiter is integrally formed with the wafer carrier such that the polishing limiter and carrier comprises a single unitary piece. Preferably, the wafer carrier/polishing limiter is stamped from a sheet of stainless steel and then coated with a suitable inert coating for preventing the stainless steel from contaminating the semiconductor wafers.

Although the circular plate 54 of the carrier 32 constitutes the polishing limiter in the preferred embodiment, it is to be understood that the polishing limiter may have other shapes or configurations. For example, the polishing limiter may comprise a plurality of fingers extending axially from the circular plate or a pair of raised annular beads extending axially from opposite faces of the circular plate.

To polish the semiconductor wafers 22, the wafers are placed in the openings of the carrier 32 which is placed axially between the upper and lower polishing surfaces 50, 52 of the polishing tables 28, 30. The initial thickness $t_1$ of the semiconductor wafers 22 is greater than the thickness $t_2$ of the polishing limiter 64 of the carrier 32 so that the wafers axially extend beyond the polishing limiter. The upper and lower polishing tables 28, 30 are axially moved toward each other so that the upper polishing surface 50 contacts the upper face 24 of the wafers 22 and the lower polishing surface 52 contacts the lower face 26 of the wafers. The upper and lower polishing surfaces then rotate relative to the wafers to polish the upper and lower faces 24, 26 of the wafers. As the wafers are polished the thickness of each decreases until the thickness is equal to the thickness $t_2$ of the polishing limiter 64. At that point, the upper rubbing surface 66 of the polishing limiter 64 is rubbed by the upper polishing surface and the lower rubbing surface 68 is rubbed by the lower polishing surface 52. Since the polishing limiter is resistant to polishing, it prevents the polishing tables from moving closer together than the distance $t_2$. Thus, even if the polishing surfaces are rotated beyond the duration needed to polish the wafers to the final thickness $t_2$, the wafers will not be over-polished.

Figure 4:
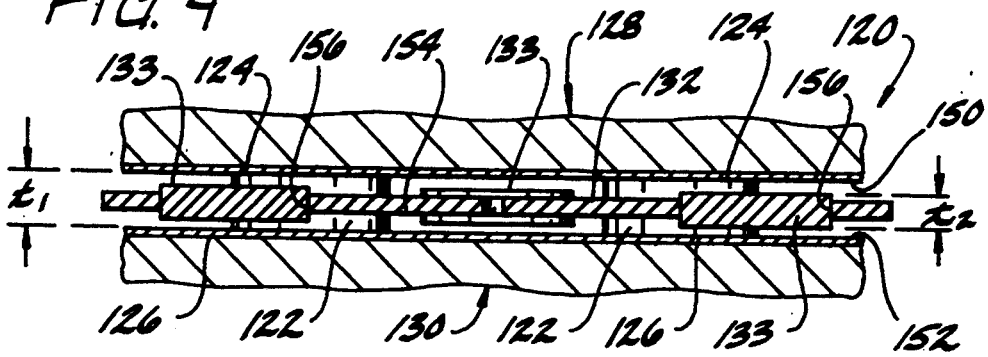
FIG. 4 is a vertical section view of another preferred embodiment of the present invention showing dummy wafers and semiconductor wafers in a staggered configuration.
Figure 5:
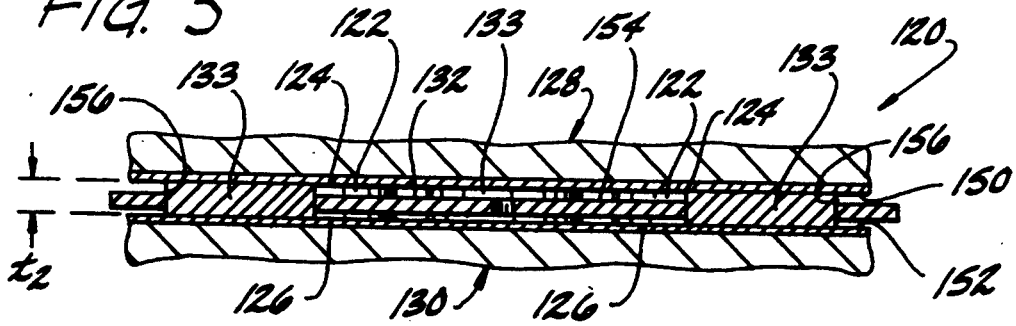
FIG. 5 is a vertical section view of the polisher of FIG. 4 but with the semiconductor wafers having been reduced in thickness equal to the thickness of the dummy wafers.

Referring now to FIGS. 4 and 5, another embodiment of a semiconductor wafer polisher of the present invention is indicated in its entirety by the reference numeral 120. To simplify the description of this embodiment, corresponding parts are numbered the same as those parts shown in FIGS. 1–3 except the prefix "1" has been added to the reference numbers.

Like the polisher 20 of FIGS. 1–3, the polisher 120 is a double sided polisher adapted to polish both faces of each semiconductor wafer 122. The polisher 120 comprises upper and lower polishing tables 128, 130, respectively, and a wafer carrier 132. The polisher 120 is similar to the polisher 20 of FIGS. 1–3 except the wafer carrier 132 does not act as a polishing limiter. The wafer carrier 132 is thinner than the predetermined final thickness $t_2$ of the wafers 122. Instead dummy wafers 133 are used as polishing limiters to limit polishing of the semiconductor wafers 122.

The wafer carrier 132 holds both the semiconductor wafers 122 and the dummy wafers 133 between the upper and lower polishing surfaces 150, 152 of the upper and lower polishing tables 128, 130 during polishing. The wafer carrier 132 comprises a generally circular plate 154 with a plurality of openings 156 for receiving the semiconductor wafers 122 and the dummy wafers 133. Preferably, the semiconductor wafers 122 and dummy wafers 133 are arranged in a staggered configuration within the openings. The thickness of the dummy wafers is equal to the predetermined final thickness $t_2$ of the semiconductor wafers 122. The dummy wafers 133 have a greater resistance to polishing than that of the semiconductor wafers 122 and may be of sapphire, quartz, silicon-carbine, boron-nitrite coated silicon, or other suitable material.

To polish the semiconductor wafers 122, the semiconductor wafers and dummy wafers are placed in the openings of the carrier 132 and the carrier is placed axially between the upper and lower polishing surfaces 150, 152 of the polishing tables 128, 130. As shown in FIG. 4, the initial thickness $t_1$ of the semiconductor wafers 122 is greater than the thickness $t_2$ of the dummy wafers 133 so that the semiconductor wafers axially extend beyond the dummy wafers. The upper and lower polishing tables 128, 130 are axially moved toward each other so that the upper polishing surface 150 contacts the upper faces 124 of the semiconductor wafers and the lower polishing surface 152 contacts the lower faces 126 of the semiconductor wafers. The upper and lower polishing surfaces are then rotated relative to the wafers to polish the upper and lower faces 124, 126 of the semiconductor wafers. As the semiconductor wafers are polished, the thickness of each decreases until the thickness is equal to the thickness $t_2$ of the dummy wafers 133. At that point (shown in FIG. 5), the upper faces (upper rubbing surfaces) of the dummy wafers 133 are rubbed by the upper polishing surface 150 and the lower faces (lower rubbing surfaces) of the dummy wafers 133 are rubbed by the lower polishing surface 152. Since the dummy wafers are resistant to polishing, they prevent the polishing tables from moving closer together than the distance $t_2$. Thus, even if the polishing surfaces are rotated beyond the duration needed to polish the semiconductor wafers to the final thickness $t_2$, the semiconductor wafers will not be over-polished.

Figure 6:
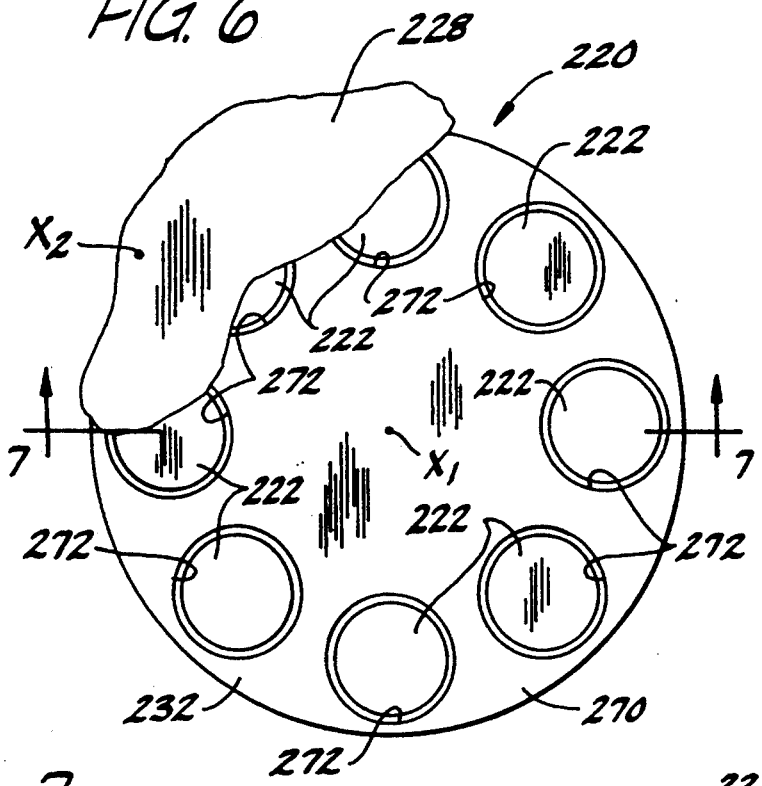
FIG. 6 is a top plan view of a further embodiment of a semiconductor wafer polisher of the present invention with portions broken away to show detail.
Figure 7:
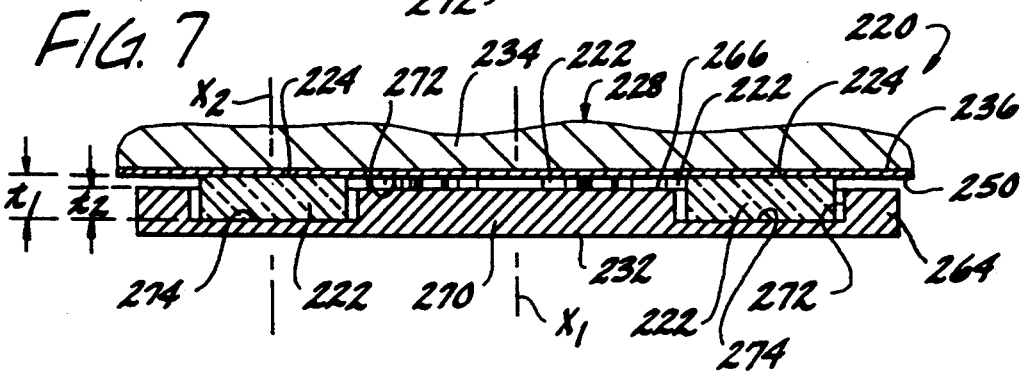
FIG. 7 is a section view taken along the plane of line 7—7 of FIG. 6 showing semiconductor wafers bonded to a wafer carrier.
Figure 8:
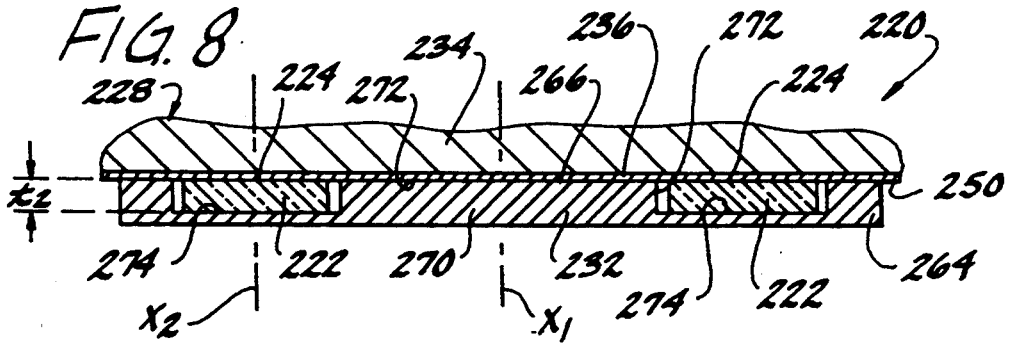
FIG. 8 is a vertical section view similar to FIG. 7 but with the semiconductor wafers having been reduced in thickness equal to the thickness of the wafer carrier.

Referring now to FIGS. 6–8, another embodiment of a semiconductor wafer polisher of the present invention is indicated in its entirety by the reference numeral 220. To simplify the description of this embodiment, corresponding parts are numbered the same as those parts shown in FIGS. 1–3 except the prefix "2" has been added to the reference numbers.

The polisher 220 is a single sided polisher adapted to polish one face of each semiconductor wafer 222. The polisher 220 comprises a polishing table 228 and a wafer carrier 232. The polishing table 228 has a polishing plate 234 and a polishing pad 236 on the plate. The polishing pad 236 includes a planar polishing surface 250 adapted to abut and rub against the upper face 224 of each semiconductor wafer 222. The wafer carrier 232 comprises a support plate 270 having a plurality of circular recesses 272, each dimensioned for receiving a semiconductor wafer 222. Each recess 272 defines a generally planar wafer holding surface 274 for holding the lower face of the corresponding semiconductor wafer 222. The wafer holding surfaces 274 are coplanar and generally parallel to the polishing surface 250. The semiconductor wafers 222 are bonded with wax to the wafer holding surfaces 274. The wafer carrier is rotatable about a first axis $X_1$ and the polishing table 228 is rotatable about a second axis $X_2$ to effectuate relative rotation between the wafer carrier and the polishing table. The wafer carrier and polishing table are urged toward each other by conventional means to press the polishing surface 250 against the upper faces 224 of the semiconductor wafers 222 so that the polishing surface rubs against the upper faces upon relative rotation thereof to wear against the upper faces of the wafers.

The portion of the support plate 270 extending above the wafer holding surfaces 274 constitutes a polishing limiter 264 for limiting the reduction in thickness of the wafers 222. Preferably, the wafer carrier 232 is a single unitary member made of ceramic or other suitable material resistant to polishing. The polishing limiter 264 has a planar rubbing surface 266 adapted for being rubbed by the polishing surface 250. Preferably, the thickness of the polishing limiter 264 (i.e., the axial distance between the rubbing surface 266 and the wafer holding surfaces 274) is equal to the predetermined final thickness $t_2$. Since the thickness of the polishing limiter 264 is less than the initial thickness $t_1$ of the wafers 222, the rubbing surface 266 is spaced from the polishing surface 250 until the wafers 222 are reduced to the final thickness $t_2$.

To polish the semiconductor wafers 222, the lower faces 226 of the wafers are bonded to the wafer holding surfaces 274 and the wafers are placed below the polishing surface 250 of the polishing table 228. As shown in FIG. 7, the initial thickness $t_1$ of the semiconductor wafers 222 is greater than the thickness $t_2$ of the polishing limiter 264 of the support plate 270 so that the wafers axially extend upward beyond the polishing limiter. The polishing table 228 and wafer carrier 232 are axially moved toward each other so that the polishing surface 250 contacts the upper face 224 of the wafers. The polishing table 228 and wafer carrier 232 then counter-rotate about their respective axes so that the upper faces 224 of the wafers 222 are polished by the polishing surface 250. As the wafers are polished, the thickness of each decreases until the thickness is equal to the thickness $t_2$ of the polishing limiter 264, as shown in FIG. 8. At that point, the rubbing surface 266 of the polishing limiter 264 is rubbed by the polishing surface. Since the polishing limiter is resistant to polishing, it prevents the polishing table and carrier from moving closer together than the distance $t_2$. Thus, even if the polishing surface is rotated beyond the duration needed to polish the wafers to the final thickness $t_2$, the wafers will not be over-polished.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A semiconductor wafer polisher for polishing at least one semiconductor wafer, the wafer having first and second opposite faces, the polisher being adapted to polish the first face of the semiconductor wafer to flatten the first face and reduce the thickness of the wafer from an initial thickness $t_1$ to a final thickness $t_2$, the final thickness $t_2$ being thinner than the initial thickness $t_1$, the polisher comprising:

a first table having a first plate and a first surface on the first plate, the first surface including a planar first surface portion adapted to abut the first face of the semiconductor wafer;

a second surface including a planar second surface portion adapted to abut the second face of the semiconductor wafer;

at least one of the first and second surfaces being rotatable about an axis to effectuate relative rotation between the planar first and second surface portions, the first and second surface portions lying in respective parallel planes;

the first surface portion comprising a planar polishing surface, the relative rotation between the first and second surfaces effectuating relative rotation between the polishing surface and the first face of the semiconductor wafer for polishing the first face;

the planar polishing surface and the second surface portion being urged toward each other to press the first face of the semiconductor wafer and the polishing surface against each other such that the planar polishing surface rubs against the first face of the semiconductor wafer upon rotation of the polishing surface relative to the semiconductor wafer to wear against the first face of the semiconductor wafer, the polishing surface and the second surface portion moving axially toward each other as the semiconductor wafer is reduced in thickness;

a wafer carrier for holding the semiconductor wafer between the polishing surface and the second surface portion;

a polishing limiter integrally formed with the wafer carrier such that the polishing limiter and wafer carrier constitute a single unitary piece, the polishing limiter is between the first and second surfaces for limiting the reduction in thickness of the wafer and has at least one rubbing surface adapted for rubbing against one of the first and second surfaces, the polishing limiter being sized and configured such that the rubbing surface is spaced axially from said one of the first and second surfaces when the semiconductor wafer has the thickness $t_1$ and such that the rubbing surface rubs against said one of the first and second surfaces and the polishing limiter extends from the second surface to the first surface when the semiconductor wafer has the thickness $t_2$, the polishing limiter having a greater resistance to polishing than that of the semiconductor wafer such that the polishing limiter prevents the polishing surface and the second surface portion from further moving axially toward each other when the polishing limiter extends from the second surface to the first surface to prevent the wafer from being reduced in thickness beyond the thickness $t_2$.

2. A semiconductor wafer polisher as set forth in claim 1 further comprising a second table having a second plate, the second surface being on the second plate, the planar second surface portion of the second surface comprising a planar polishing surface, the relative rotation between the first and second surfaces effectuating relative rotation between the polishing surface of the second table and the second face of the semiconductor wafer for polishing the second face.

3. A semiconductor wafer polisher as set forth in claim 2 wherein the rubbing surface of the polishing limiter constitutes a first rubbing surface at one end of the carrier for rubbing against the first surface of the first table, the polishing limiter further comprising a second rubbing surface at an opposite end of the carrier for rubbing against the second surface of the second table, the polishing limiter being sized and configured such that not more than one of the first and second rubbing surfaces of the polishing limiter rubs against one of the first and second surfaces of the tables when the semiconductor wafer has the thickness $t_1$, and the first rubbing surface rubs against the first surface of the first table and the second rubbing surface rubs against the second surface of the second table when the semiconductor wafer has the thickness $t_2$ to prevent the polishing surfaces of the first and second tables from further moving axially toward each other.

4. A semiconductor wafer polisher as set forth in claim 3 wherein the polishing limiter is configured such that the first rubbing surface is adapted for rubbing against the polishing surface of the first table and the second rubbing surface is adapted for rubbing against the polishing surface of the second table, the axial distance between the first and second rubbing surfaces being equal to the thickness $t_2$.

5. A semiconductor wafer polisher as set forth in claim 1 wherein the wafer carrier comprises a support plate, the second surface comprising a generally planar wafer holding surface on the support plate for holding the second face of the wafer.

6. A semiconductor wafer polisher as set forth in claim 5 wherein the polishing limiter extends axially from the support plate toward the first surface of the first table, the rubbing surface of the polishing limiter being adapted for rubbing against the first surface of the first table, the polishing limiter being sized and configured such that the rubbing surface is axially spaced from the first surface of the first table when the semiconductor wafer has the thickness $t_1$ and such that the rubbing surface rubs against the first surface of the first table when the semiconductor wafer has been reduced to the thickness $t_2$.

7. A semiconductor wafer polisher as set forth in claim 6 wherein the polishing limiter is configured such that the rubbing surface rubs against the polishing surface of the first table when the semiconductor wafer has been reduced to the thickness $t_2$.

8. A semiconductor wafer polisher for polishing at least one semiconductor wafer, the wafer having first and second opposite faces, the polisher being adapted to polish the first face of the semiconductor wafer to flatten the first face and reduce the thickness of the wafer from an initial thickness $t_1$ to a final thickness $t_2$, the final thickness $t_2$ being thinner than the initial thickness $t_1$, the polisher comprising:

a wafer carrier having a support plate and a generally planar wafer holding surface on the support plate for holding the second face of the wafer;

a polishing table having a polishing plate and a planar polishing surface on the polishing plate lying in a plane parallel to the planar wafer holding surface;

at least one of the wafer carrier and polishing table being rotatable about an axis to effectuate relative rotation between the wafer carrier and polishing table;

the planar polishing surface being adapted to abut the first face of the semiconductor wafer for polishing the first face upon relative rotation between the wafer holding surface and the polishing surface;

the planar wafer holding surface and the planar polishing surface being urged toward each other to press the first face of the semiconductor wafer and the polishing surface against each other such that the planar polishing surface rubs against the first face of the semiconductor wafer upon rotation of the polishing surface relative to the semiconductor wafer to wear against the first face of the semiconductor wafer, the wafer holding surface and the polishing surface moving axially toward each other as the semiconductor wafer is reduced in thickness;

a polishing limiter integrally formed with one of the support plate and polishing plate such that the polishing limiter and said one of the support plate and polishing plate constitute a single unitary piece, the polishing limiter extending axially from said one of the support plate and polishing plate toward the other of the support plate and polishing plate for limiting reduction in thickness of the wafer, the polishing limiter having a plate rubbing surface adapted for rubbing against said other of the support plate and polishing plate, the polishing limiter being sized and configured such that the plate rubbing surface is axially spaced from said other of the support plate and polishing plate when the semiconductor wafer has the thickness $t_1$ and such that the plate rubbing surface rubs against said other of the support plate and polishing plate when the semiconductor wafer has been reduced to the thickness $t_2$, the plate rubbing surface having a greater resistance to polishing than that of the semiconductor wafer such that the polishing limiter prevents the wafer holding surface and the polishing surface from further moving axially toward each other when the plate rubbing surface rubs against said other of the support plate and polishing plate to prevent the wafer from being reduced in thickness beyond the thickness $t_2$.

9. A semiconductor wafer polisher as set forth in claim 8 wherein the polishing table comprises a turntable rotatable about the axis to effectuate relative rotation between the planar polishing surface and the first face of the semiconductor wafer.

10. A semiconductor wafer polisher as set forth in claim 9 wherein the polishing limiter is formed as one piece with the support plate and extends axially therefrom toward the polishing plate.

11. A semiconductor wafer polisher as set forth in claim 10 wherein the polishing limiter is configured such that the rubbing surface rubs against the polishing surface of the polishing table when the semiconductor wafer has been reduced to the thickness $t_2$.

12. A semiconductor wafer polisher for polishing semiconductor wafers, each semiconductor wafer having first and second opposite faces, the polisher being adapted to polish the first and second faces of the semiconductor wafers to flatten the faces and reduce the thickness of the semiconductor wafers from an initial thickness $t_1$ to a final thickness $t_2$, the final thickness $t_2$ being thinner than the initial thickness $t_1$, the polisher comprising:

a first polishing table having a first plate and a first surface on the first plate, the first surface including a first planar polishing surface portion adapted to abut the first faces of the semiconductor wafers;

a second polishing table having a second plate and a second surface on the second plate, the second surface including a second planar polishing surface portion parallel to the first planar polishing surface portion and adapted to abut the second faces of the semiconductor wafers;

a generally planar wafer carrier for holding the semiconductor wafers between the first and second polishing surfaces, the carrier having at least three openings therein, two of the openings being adapted for receiving the semiconductor wafers and the other opening being adapted for receiving a dummy wafer, the carrier having a thickness less than the thickness $t_2$;

the first and second plates each being rotatable about an axis perpendicular to the first and second polishing surface portions to effectuate relative rotation between the first and second polishing surface portions and the first and second faces of the semiconductor wafers for polishing the first and second faces;

the first and second polishing surface portions being urged toward each other such that upon rotation of the first and second polishing surface portions, the polishing surfaces rub against the first and second faces of the semiconductor wafers to polish the first and second faces of the semiconductor wafers, the polishing surface portions moving axially toward each other as the semiconductor wafers are reduced in thickness;

at least one dummy wafer receivable within said other opening in the wafer carrier, said dummy wafer having first and second generally planar rubbing surfaces on opposite faces thereof, said surfaces being adapted to rub against the polishing surface portions and being spaced apart a distance equal to the thickness $t_2$ such that the first and second rubbing surfaces rub against the first and second polishing surface portions respectively when the semiconductor wafers have been polished to the thickness $t_2$, the dummy wafer having a greater resistance to polishing than that of the semiconductor wafers so that the dummy wafer prevents the polishing surface portions from further moving axially toward each other when the first and second rubbing surfaces respectively rub against the first and second polishing surface portions to prevent the semiconductor wafers from being reduced in thickness beyond the thickness $t_2$.

13. A method of polishing a semiconductor wafer wherein the semiconductor wafer has first and second opposite faces and at least the first face of the semiconductor wafer is adapted to be polished to flatten the first face and reduce the thickness of the semiconductor wafer from an initial thickness $t_1$ to a final thickness $t_2$, the final thickness $t_2$ being thinner than the initial thickness $t_2$, the method comprising:

supporting the semiconductor wafer between a first table and a second surface by way of a wafer carrier, the first table having a first plate and a first surface on the first plate, the first surface including a planar first surface portion adapted to abut the first face of the semiconductor wafer, the first surface portion of the first table comprising a planar polishing surface, the second surface having a planar second surface portion adapted to abut the second face of the semiconductor wafer, the first and second surface portions lying in respective parallel planes;

at least one of the first and second surfaces being rotatable about an axis to effectuate relative rotation between the planar first and second surface portions, the axis being perpendicular to the respective parallel planes of the first and second surface portions, the relative rotation between the first and second surfaces effectuating relative rotation between the polishing surface and the first face of the semiconductor wafer for polishing the first face;

positioning at least one polishing limiter between the first and second surfaces for limiting the reduction in thickness of the wafer, the polishing limiter being integrally formed with the wafer carrier such that the polishing limiter and the wafer carrier constitute a single unitary piece, the polishing limiter having at least one rubbing surface adapted for rubbing against one of the first and second surfaces, the polishing limiter being sized and configured such that the rubbing surface is spaced axially from said one of the first and second surfaces when the semiconductor wafer has the thickness $t_1$ and such that the rubbing surface rubs against said one of the first and second surfaces and the polishing limiter extends from the second surface to the first surface when the semiconductor wafer has the thickness $t_2$, the polishing limiter having a greater resistance to polishing than that of the semiconductor wafer such that the polishing limiter prevents the polishing surface and the second surface portion from moving axially toward each other when the polishing limiter extends from the second surface to the first surface to prevent the wafer from being reduced in thickness beyond the thickness $t_2$;

rotating at least one of the first and second surfaces about the axis;

urging the planar polishing surface and the second surface portion toward each other to press the first face of the semiconductor wafer and the polishing surface against each other such that the planar polishing surface rubs against the first face of the semiconductor wafer upon rotation of the polishing surface relative to the semiconductor wafer to wear against the first face of the semiconductor wafer, the polishing surface and the second surface portion moving axially toward each other as the semiconductor wafer is reduced in thickness and until the semiconductor wafer has been reduced to the thickness $t_2$, the rubbing surface rubbing against the one of the first and second surfaces and the polishing limiter extending from the second surface to the first surface when the semiconductor wafer has been reduced to the thickness $t_2$ to prevent the polishing surface and the second surface portion from further moving axially toward each other thereby to prevent the wafer from being reduced in thickness beyond the thickness $t_2$.

14. A method of polishing a semiconductor wafer as set forth in claim 13 wherein the second surface comprises a surface on a second plate of a second table, the planar second surface portion of the second surface comprising a planar polishing surface of the second table, the relative rotation between the first and second surfaces effectuating relative rotation between the polishing surface of the second table and the second face of the semiconductor wafer to polish the second face.

15. A method of polishing a semiconductor wafer as set forth in claim 14 wherein the rubbing surface of the polishing limiter constitutes a first rubbing surface at one end of the carrier for rubbing against the first surface of the first table, the polishing limiter further comprising a second rubbing surface at an opposite end of the carrier for rubbing against the second surface of the second table, the polishing limiter being sized and configured such that not more than one of the first and second rubbing surfaces of the polishing limiter rubs against one of the first and second surfaces of the tables when the semiconductor wafer has the thickness $t_1$, and the first rubbing surface rubs against the first surface of the first table and the second rubbing surface rubs against the second surface of the second table when the semiconductor wafer has the thickness $t_2$ to prevent the polishing surfaces of the first and second tables from further moving axially toward each other.

16. A method of polishing a semiconductor wafer as set forth in claim 15 wherein the polishing limiter is configured such that the first rubbing surface is adapted for rubbing against the polishing surface of the first table and the second rubbing surface is adapted for rubbing against the polishing surface of the second table, the first and second rubbing surfaces being axially spaced a distance equal to the thickness $t_2$.

17. A method of polishing a semiconductor wafer as set forth in claim 13 wherein the wafer carrier comprises a support plate, the second surface comprising a generally planar wafer holding surface on the support plate for holding the second face of the wafer.

18. A method of polishing a semiconductor wafer as set forth in claim 17 wherein the polishing limiter extends axially from the support plate toward the first surface of the first table, the rubbing surface of the polishing limiter being adapted for rubbing against the first surface of the first table, the polishing limiter being sized and configured such that the rubbing surface is axially spaced from the first surface of the first table when the semiconductor wafer has the thickness $t_1$ and such that the rubbing surface rubs against the first surface of the first table when the semiconductor wafer has been reduced to the thickness $t_2$.

19. A method of polishing a semiconductor wafer wherein the semiconductor wafer has first and second opposite faces and at least the first face of the semiconductor wafer is adapted to be polished to flatten the first face and reduce the thickness of the semiconductor wafer from an initial thickness $t_1$ to a final thickness $t_2$, the final thickness $t_2$ being thinner than the initial thickness $t_1$, the method comprising:

supporting the semiconductor wafer by way of a wafer carrier having a support plate and a generally planar wafer holding surface on the support plate, the second face of the wafer being held against the wafer holding surface;

positioning a polishing table against the first face of the semiconductor wafer, the polishing table having a polishing plate and a planar polishing surface on the polishing plate lying in a plane parallel to the planar wafer holding surface, the planar polishing surface abutting the first face of the semiconductor wafer;

at least one of the wafer carrier and the polishing table being rotatable about an axis to effectuate relative rotation between the wafer carrier and the polishing table, the axis being perpendicular to the planar polishing surface and the planar wafer holding surface;

limiting reduction in thickness of the semiconductor wafer with a polishing limiter, the polishing limiter being integrally formed with one of the support plate and polishing plate such that the polishing limiter and said one of the support plate and polishing plate constitute a single unitary piece, the polishing limiter extending axially from said one of the support plate and polishing plate toward the other of the support plate and polishing plate and having a plate rubbing surface adapted for rubbing against said other of the support plate and polishing plate, the polishing limiter being sized and configured such that the plate rubbing surface is axially spaced from said other of the support plate and polishing plate when the semiconductor wafer has the thickness $t_1$ and such that the plate rubbing surface rubs against said other of the support plate and polishing plate when the semiconductor wafer has been reduced to the thickness $t_2$, the plate rubbing surface having a greater resistance to polishing than that of the semiconductor wafer such that the polishing limiter prevents the wafer holding surface and the polishing surface from moving axially toward each other when the plate rubbing surface rubs against said other of the support plate and polishing plate to prevent the wafer from being reduced in thickness beyond the thickness $t_2$;

rotating at least one of the wafer carrier and the polishing table about the axis to effectuate relative rotation between the polishing surface and the first face of the semiconductor wafer;

urging the planar wafer holding surface and the planar polishing surface toward each other during relative rotation between the polishing surface and the first face of the semiconductor wafer to press the first face of the semiconductor wafer and the polishing surface against each other such that the planar polishing surface rubs against the first face of the semiconductor wafer to wear against the first face of the semiconductor wafer, the wafer holding surface and the polishing surface moving axially toward each other as the semiconductor wafer is reduced in thickness and until the semiconductor wafer has been reduced to the thickness $t_2$, the plate rubbing surface rubbing against the other of the support plate and polishing plate when the semiconductor wafer has been reduced to the thickness $t_2$ to prevent the wafer holding surface and the polishing surface from further moving axially toward each other thereby to prevent the wafer from being reduced in thickness beyond the thickness $t_2$.

20. A method of polishing a semiconductor wafer as set forth in claim 19 wherein the polishing table comprises a turntable rotatable about the axis to effectuate relative rotation between the planar polishing surface and the first face of the semiconductor wafer.

21. A method of polishing a semiconductor wafer as set forth in claim 19 wherein the polishing limiter is integrally formed as a single unitary piece with the support plate and extends axially therefrom toward the polishing plate.

22. A method of polishing a semiconductor wafer as set forth in claim 21 wherein the polishing limiter is configured such that the rubbing surface rubs against the polishing surface of the polishing table when the semiconductor wafer has been reduced to the thickness $t_2$.

* * * * *

UNITED STATES PATENT AND TRADEMARK OFFICE

CERTIFICATE OF CORRECTION

PATENT NO. : 5,422,316

DATED : June 6, 1995

INVENTOR(S) : Ankur H. Desai, Michael S. Wisnieski and David-I. Golland

It is certified that error appears in the above-identified patent and that said Letters Patent is hereby corrected as shown below:

In column 12, claim 13, lines 10 and 11 should read "the final thickness $t_2$ being thinner than the initial thickness $t_1$, the".

Signed and Sealed this

Seventh Day of May, 1996

Bruce Lehman

*Attest:*

BRUCE LEHMAN

*Attesting Officer*

*Commissioner of Patents and Trademarks*